United States Patent [19]

Cook

[11] Patent Number: 4,527,901

[45] Date of Patent: Jul. 9, 1985

[54] ULTRASONIC CLEANING TANK

[75] Inventor: Edward G. Cook, New Milford, Conn.

[73] Assignee: Ultrasonic Power Corporation, Freeport, Ill.

[21] Appl. No.: 553,723

[22] Filed: Nov. 21, 1983

[51] Int. Cl.[3] ..... B01F 11/02

[52] U.S. Cl. ..... 366/127; 310/26

[58] Field of Search ..... 366/127, 114, 116; 310/325, 334, 346, 26; 134/1, 184

[56] References Cited

U.S. PATENT DOCUMENTS

| | | | |
|---|---|---|---|
| 3,187,207 | 6/1965 | Tomes | 310/325 |
| 3,254,284 | 5/1966 | Tomes | 366/114 |
| 3,371,233 | 2/1968 | Cook | 366/114 |
| 3,396,286 | 8/1968 | Anderson | 366/114 |
| 3,433,462 | 3/1969 | Cook | 366/127 |
| 3,596,883 | 8/1971 | Brech | 366/127 |
| 4,227,817 | 10/1980 | Gerry | 366/127 |

*Primary Examiner*—Robert W. Jenkins

*Attorney, Agent, or Firm*—Sperry, Zoda & Kane

[57] ABSTRACT

An ultrasonic cleaning system utilizes a manufacturing technique wherein one or more piezoelectric elements are fused, secured by a gold sputtering technique, or attached by electrochemical deposition to an associated metal surface, whether it be a metal cleaning tank or an electrode, by a gas-tight joint or connection, eliminating the necessity of utilizing conventional techniques that require bonding of the element or elements to the associated metal surfaces by epoxy compounds or the like. The novel technique is practiced, in some forms of the invention, by molding the piezoelectric elements integrally with ceramic materials utilized for the liquid cleaning tank itself, and thereafter polarizing the area or areas that are to be made piezoelectric. In other forms, a metal cleaning tank may be used, but in every instance the fusing of the piezoelectric mixture to the tank walls and/or electrodes is accomplished during the firing of the ceramic material of which the piezoelectric element is formed.

14 Claims, 9 Drawing Figures

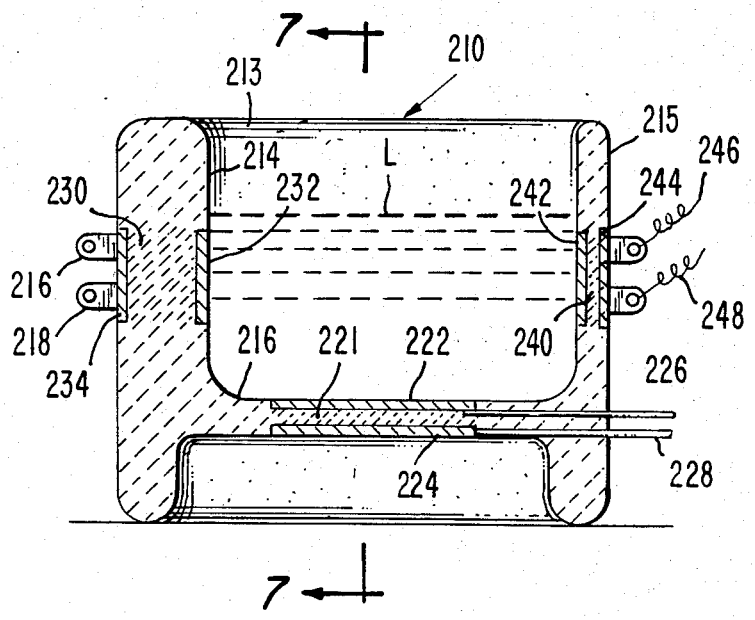
FIG. 6
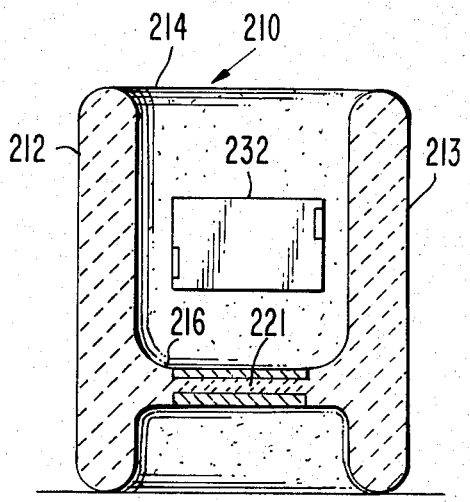
FIG. 7
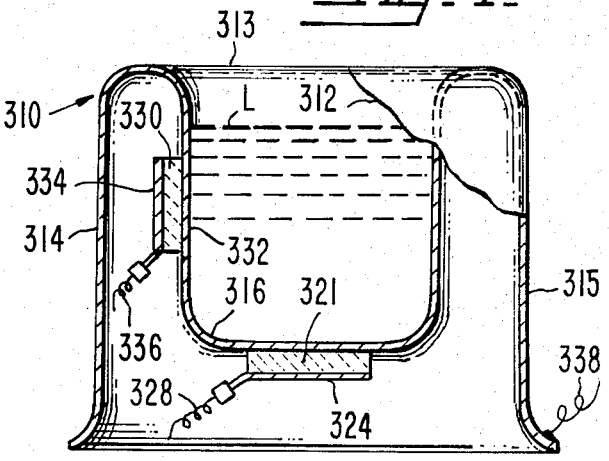
FIG. 8
FIG. 9
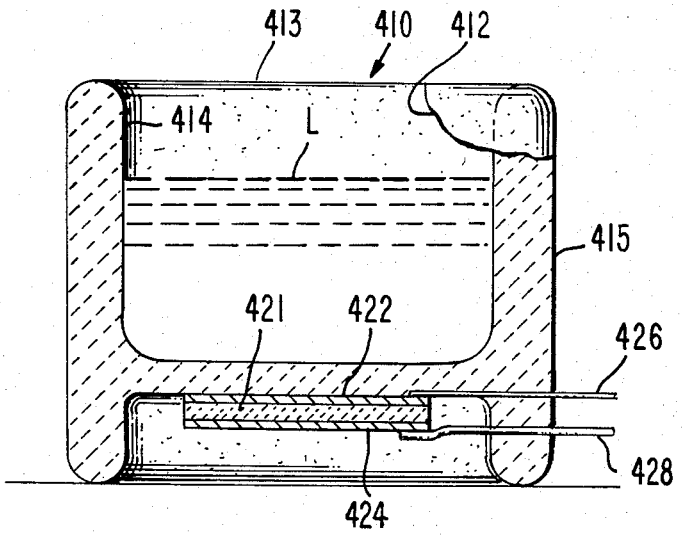

ULTRASONIC CLEANING TANK

BACKGROUND OF THE INVENTION

1. Field Of The Invention

In a general sense, the invention relates to ultrasonic cleaning systems. More particularly, the invention refers to an improved manufacturing technique relating to the cleaning tank, cleaning tank housing, and piezoelectric elements embodied therein.

2. Description Of The Prior Art

Heretofore, the manufacture of cleaning tanks, cleaning tank housings, and piezoelectric elements, and the assembly of these components of a typical ultrasonic cleaning system, have posed considerable problems. Typically, the tank is made as a component separate and distinct from the piezoelectric element or elements that are to be assembled therewith, and also as a component separate from a tank housing. Problems have arisen in attaching the piezoelectric element to the cleaning tank, attaching the cleaning tank to the housing, generating lower ultrasonic frequencies and/or a multiplicity of frequencies from a single, thin piezoelectric element, and finally, providing means for electrically energizing the element or elements.

These difficulties have added to the cost of manufacture, and even with the relatively high cost involved, there have been serious problems resulting from the, at times, great difficulty of attaching the components in a way to prevent loss of function or malfunction thereof.

For example, in attaching the tank to the housing, problems have arisen because of the difficulties of making a liquid-tight joint. Cleaning liquids utilized in systems of this type frequently are strong acids, alkalines, or solvents. Liquids of this type often find their way into the piezoelectric area through the joint between the tank and housing, and attack either the piezoelectric element, or the means bonding that element to the tank, or in some instances both.

The basic and main purpose of the present invention is to provide an assembled ultrasonic cleaning tank and piezoelectric element or elements, that will have none of the deficiencies present in the prior art devices discussed above.

SUMMARY OF THE INVENTION

To this end, the present invention may be briefly summarized as comprising a cleaning tank which combines the functions of both a housing and tank, so as to eliminate the formation of a separate housing and the attendant problems resulting from connection of the tank thereto, problems which have been discussed briefly above.

In accordance with the invention, it is proposed in one, preferred form thereof, to provide a tank which comprises a mud/slurry mixture, which is formed within a mold to the desired end shape, and which is then fired at an elevated temperature. The fired ceramic mixture, when removed from the mold, can be ground to an appropriate thickness dimension, according to the thickness of the particular piezoelectric element selected relative to the frequencies at which the element is intended to resonate when the ultrasonic cleaning system is in use.

In a preferred form of the invention, electrodes are applied to opposite faces of a selected wall area, or to a plurality of wall areas, of the molded ceramic tank, and are energized for the purpose of polarizing this area of the tank to make it piezoelectric.

Various forms of the invention are disclosed, in one of which the wall of the tank may be ground down for the purpose of receiving the electrodes. In another form, the electrodes may be molded directly into the ceramic mixture. In yet another form, the tank walls are intentionally molded to selected, different thicknesses, for the purpose of receiving a plurality of pairs of electrodes, with each of the differing wall thicknesses defining areas that are polarized to be made piezoelectric, and which accordingly resonate at a multiplicity of different frequencies when the ultrasonic cleaning system is in use.

Still another form of the invention utilizes the provision of a stainless steel tank, with the molded piezoelectric elements being fused to the tank wall and/or to the appropriate electrodes, thus giving effect to the basic concept of fusion of the piezoelectric ceramic material to the tank (whether it be of metal or ceramic) at the time of the initial firing of the ceramic material defining the piezoelectric area or element, thus dispensing with expensive bonding techniques utilizing epoxy adhesives or the like heretofore required.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 4 is a view like FIG. 2, showing a modified form in which the step of grinding the piezoelectric area is dispensed with;

FIG. 6 is a view like FIG. 2, showing a third modification, wherein the walls of the tank have been molded to different thicknesses, for the purpose of defining a plurality of piezoelectric areas each of which resonates at a different frequency;

FIG. 7 is a transverse sectional view, substantially on line 7—7 of FIG. 6;

FIG. 8 is a view like FIG. 6, showing the invention as embodied in a cleaning tank of metal material; and FIG. 9 is a view like FIG. 2, showing still another embodiment of the invention, in which the piezoelectric element has been molded separately from the molding of the tank, and is fused to the associated electrodes on firing of the tank and the element.

DETAILED DESCRIPTION OF THE PREFERRED EMBODIMENTS

Figure 1:
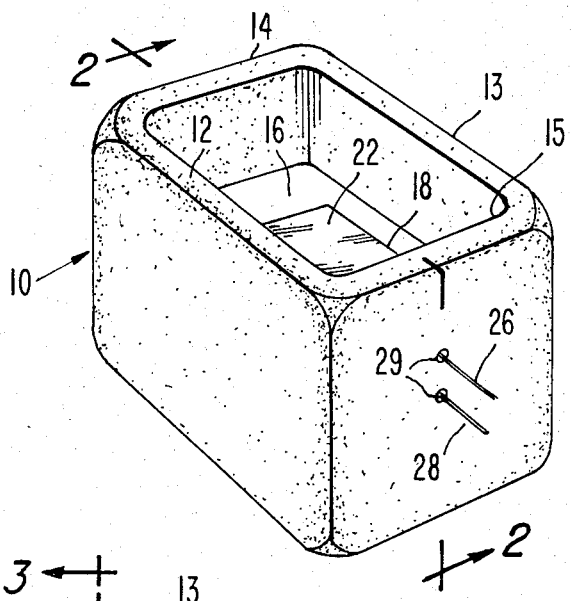
FIG. 1 is a perspective view of a molded ceramic cleaning tank, in which the piezoelectric area has been molded integrally with a wall of the tank, and wherein the area has been ground down to receive electrodes inserted preliminary to firing of the ceramic tank and piezoelectric materials.
Figure 2:
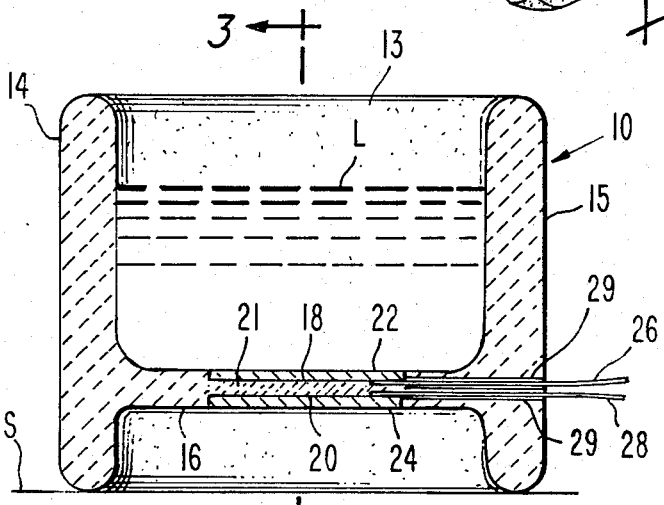
FIG. 2 is a longitudinal sectional view through the tank of FIG. 1, taken substantially on line 2—2 of FIG. 1.
Figure 3:
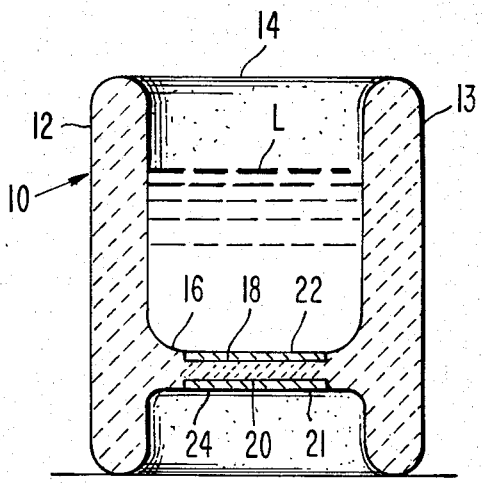
FIG. 3 is a transverse sectional view thereof, taken on line 3—3 of FIG. 2.

In the form of the invention shown in FIGS. 1-3, there is illustrated a liquid-retaining tank generally designated 10, adapted to hold a cleaning liquid L, which may be an acid, alkaline, solvent, or other liquid material found suitable and desirable for a specific cleaning application utilizing ultrasonic frequencies.

In this form of the invention, a suitable mud/slurry ceramic mixture is poured into a mold, not shown, to form a cleaning tank that is comprised wholly of a ceramic material. The molded ceramic mixture, thereafter, is fired at an elevated temperature, utilizing the technique known to the ceramic field in the manufacture of ceramic ware such as dishes, insulators, art objects, etc.

The mixture, when fired, is removed from the mold, and as shown in the drawing, in its molded form the tank now comprises upstanding longitudinal walls 12, 13, and end walls 4, 15 respectively. Of course, the tank can be of any particular configuration, the rectangular configuration shown being illustrated merely by way of one example of a tank of this type. The tank could be square, or in any other suitable shape best suited for obtaining maximum effect from the frequencies generated by excitation of the piezoelectric element or elements associated with the tank.

In the illustrated example, a bottom wall 16 of the tank, elevated above the supporting surface S on which the tank rests, is formed to comprise, in part, a piezoelectric element or area 21, disposed between electrodes 22, 24 from which conductors 26, 28 extend outwardly through the adjacent wall 15 of the tank.

In FIGS. 1–3, the opposite faces of the piezoelectric area 21 are ground down as at 18, 20 to define shallow, completely flat recesses accommodating the electrodes 22, 24, so that the electrodes will be recessed flush with the opposite faces or surfaces of the bottom wall 16, and will be in full intimate, face-to-face contact with the opposite faces of the ground-down piezoelectric area 21.

The conductors 26, 28 can be inserted through openings 29 formed in the wall surface of the tank after molding thereof and following the grinding-in of the shallow recesses 18, 20 required for receiving the electrodes, and can then be secured to the electrodes. Openings 29 can then be filled or plugged with a suitable cement.

Alternatively, the wires or conductors 26, 28 may be inserted through the wall 15 during the process of forming the tank and may be secured to the electrodes at that time, after which the tank may be fired with the wires in place.

The formation of the molded ceramic tank provides, at one and the same time, both a tank and a housing, since the requirement previously existing for manufacturing a cleaning tank (usually of a single thickness of metal) and then mounting it within a housing for the purpose of imparting strength and stability thereto and for the purpose also of accommodating the various electrical components, is eliminated.

It may be noted, in this regard, that after molding of the tank, the next step is to fire the mud/slurry mixture, after which the surfaces 18, 20 are ground down to a specified extent, to produce a piezoelectric element 21 that is of the exact thickness desired for the particular frequency at which it is to be resonated.

After the grinding step, the wires are inserted through the openings 29, which may be formed in the wall of the tank during the molding step, or which alternatively may be machined after the firing step. Of course, as noted above the wires may have already been in place before the firing step.

In a construction such as shown in FIGS. 1–3, the problem remains that the electrodes, since they are applied to the piezoelectric area 21 after firing of the ceramic material, must be separately attached to said area after the piezoelectric area has been ground in the manner described above. Grinding is a relatively expensive procedure, as is the procedure of bonding the electrodes to the piezoelectric element. Accordingly, it is proposed, as noted previously herein, to fuse the electrodes to the piezoelectric area, or attach them by electro-chemical deposition or by gold sputtering techniques.

It is well known, in this connection, that the ultrasonic cleaning action results from a combination of ultrasonic cavitation and chemical action. The cavitation occurs when ultrasonic frequencies are generated within the cleaning liquid as a response to imparting vibratory modes in the piezoelectric element. A detailed discussion of the application of this type of energy to an ultrasonic cleaning tank is found in my U.S. Pat. No. 3,371,233 issued Feb. 27, 1968; and U.S. Pat. No. 3,433,462 issued Mar. 18, 1969.

In any event, for the purposes of the present application it may be noted that it is important, to assure generation of the desired frequencies, that the electrodes be perfectly flat, hence the requirement for precision grinding and carefully applied electrode deposition techniques.

This involves, in the form shown in FIGS. 1–3, the deposition of electrodes on the ground surfaces by conventional techniques such as silver chemical deposition or vacuum sputtering of gold.

Whether the attachment of the electrodes to the piezoelectric area is by means of one of the above-described deposition techniques, or by some other technique, it is essential that there be an intimate contact between the piezoelectric element and any adjacent surface, as for example, the electrodes shown in FIGS. 1–3. This is required so that no air or other gas may exist between the ceramic material of the piezoelectric element, and the electrode. Gaseous infiltration into this area must be avoided, because it will completely attenuate any ultrasonic vibrations. At present this is accomplished by using an epoxy bonding technique to attach the polarized piezoelectric element to the tank bottom, after the electrodes have been attached to the piezoelectric area by chemical deposition.

The form of the invention shown in FIGS. 1–3 retains some of the techniques, and hence some of the problems, associated with conventional manufacture of ultrasonic cleaning systems. For example, in this form of the invention, the electrodes are still secured to the piezoelectric area by conventional deposition techniques discussed above. And, grinding of the piezoelectric area to a perfectly flat condition, to receive correspondingly flat electrodes, is also required.

The construction shown in FIGS. 1–3, however, still has certain distinct advantages over conventional ultrasonic cleaning tank manufacturing techniques. For example, conventionally a tank and housing are made as separate components, and are thereafter assembled by an elaborate bonding technique in which the greatest care must be taken to produce a liquid-tight joint in the areas of attachment between the tank and housing. This is required to prevent the cleaning liquids from finding their way into the piezoelectric areas through the joint between the tank and housing, where they tend to attack either the piezoelectric element, or the area in which the bonding technique has been applied, or both.

In the form of the invention shown in FIGS. 1–3, this particular problem is eliminated in that the tank is molded of a ceramic material, integrally with the piezoelectric area itself. The provision of a housing for protecting the piezoelectric area is thereby eliminated, together with the problems attendant upon formation of a joint between the tank and housing. Further, in the form of FIGS. 1–3, a considerable advantage results from molding the piezoelectric area as an integral part of the ceramic tank. The necessity of attaching a separate piezoelectric element to the tank, by means of an epoxy bond, is dispensed with, along with the above-discussed problems resulting from use of the epoxy bonding attachment techniques.

It is considered, in connection with the concept illustrated in FIGS. 1–3, that it is also possible to utilize a specially designed type of piezoelectric ceramic for the area 21, to be applied within the mold along with the ceramic used for the rest of the tank. This may be desirable because in some instances, the area 21 may be so thin as to cause an ordinary ceramic to be too weak, or excessively brittle. An alternative method, accordingly, not only in the form of FIGS. 1–3, but also in other forms of the invention in which the piezoelectric area is an integral part of the tank itself, would be to use one type of ceramic material for the tank proper, and a different, stronger form for the piezoelectric area. Both types of ceramic can be inserted into the same mold, and would fuse together upon the initial firing of the ceramic.

A highly desirable feature, in a construction such as shown in FIGS. 1–3, resides in the fact that the electrodes can be shaped in any way desired. They may, for example, be square, rectangular, oblong, triangular, or any other suitable shape. By so shaping the electrodes, the resonant frequencies of the piezoelectric element can be controlled. These resonances would be lower than the frequency resonance determined by the resulting thickness of the piezoelectric area 21. The presence of the integral ceramic structure itself has the effect of lowering the resonance frequencies. This characteristic, taken with the formation of the electrodes in any of a variety of configurations, adds to the lowering of the frequencies, a condition known in ultrasonic cleaning as being highly desirable. Cleaning in such systems is more efficient in the 40 kHz. range. Normally, in order to be resonant at 40 kHz., the thickness of the piezoelectric area would have to approach 2". This great thickness poses fabrication problems in the design of ultrasonic cleaning systems. Therefore, by varying the shape of the electrode, resonances in the 40 kHz. range are obtained even though the thickness of the piezoelectric area may be in the range of $\frac{1}{4}''$–$\frac{1}{2}''$.

The existence of the thickness resonance as well as the electrode dimension resonances affords the possibility of energizing the structure in a manner which would permit more than one resonant frequency to be present in the cavitating liquid. The desirability of a multiplicity of frequencies occurring simultaneously within the tank has been fully discussed, and indeed is an important feature, of my above-mentioned U.S. Pat. No. 3,371,233.

Figure 4:
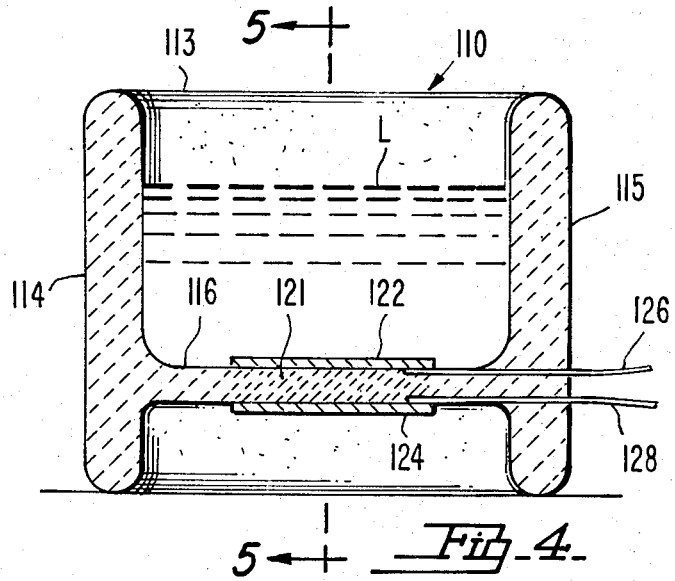
Figure 5:
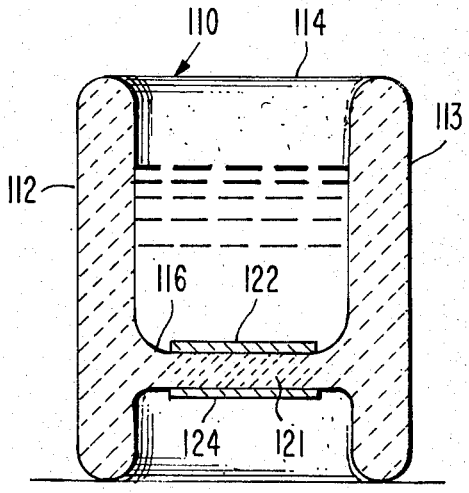
FIG. 5 is a transverse sectional view substantially on line 5—5 of FIG. 4.

In the form of the invention shown in FIGS. 4 and 5, the advantages of the first form of the invention are retained, together with important additional advantages. In this form, the tank has been generally designated 110 and is a one-piece, molded, ceramic structure similar in general shape to that of the first form. Thus, it has end walls 114, 115, and side walls 112, 113, cooperating with a bottom wall 116 to define a container for the cleaning liquid L. A selected area of the bottom wall 116, designated 121, provides the piezoelectric element when suitably polarized.

In this form of the invention, the necessity of grinding of the piezoelectric element after firing, and attachment of the electrodes to the piezoelectric element by chemical deposition or other conventional techniques, are all eliminated. Instead, stainless steel plates may be inserted into the mold prior to firing, in order to provide electrodes 122, 124. As a result, these electrodes will be fired with the ceramic material itself, after the tank has been molded. This eliminates the requirement of attachment of the electrodes to the piezoelectric area as a separate step.

The firing technique of the mud/slurry mixture in this arrangement is similar to that now conventionally employed in the molding of many objects, such as ceramic dinnerware, insulators, or the like. In some of these objects, metal components are inserted prior to molding and firing. The same procedure would be employed in the form of the invention shown in FIGS. 4 and 5.

In this form of the invention, although the electrodes have been shown in non-recessed positions relative to the piezoelectric area 121, they could be molded into said area as to be flush with the surface of the bottom wall 116, similarly to the arrangement shown in FIGS. 1–3.

Either before or after the firing step, conductors 126, 128 can be attached to the electrodes in the manner previously discussed with respect to FIGS. 1–3.

At this point, it may be noted that an important, final step is utilized in all forms of the invention, that is, polarizing area 21 or 121 to make it piezoelectric. The polarization technique comprises reheating the ceramic after it has been previously fired, to its Curie temperature. This temperature is lower than the original firing temperature. Thereafter, one applies a high DC voltage across the electrodes, after which the structure is cooled to room temperature while maintaining the DC voltage.

This procedure lines up the electric dipoles in the small ferro-electric domains within the piezoelectric area 21 or 121, such that application of an alternating high voltage waveform between the electrodes will cause the polarized area to expand and contract, that is, respond in a piezoelectric mode. This response can occur only in the areas of the fired structure where the electrodes are located, and where the above-mentioned DC voltage has been applied during the initial polarization step.

In the form of the invention shown in FIGS. 6 and 7, I have illustrated a type of tank, utilizing the concepts previously discussed herein, in which different walls of the tank are molded to different thicknesses, and have their own piezoelectric areas. This produces a multiplicity of different frequencies, within the cleaning liquid L, over a wide frequency range, including, as is highly desirable, frequencies in, for example, the 40 kHz. range.

In this form of the invention, the tank has been generally designated 210, and as in the other forms is a molded, one-piece, ceramic container having side walls 212, 213, and end walls 214, 215, with a raised bottom wall 216.

While it is previously known to generate a plurality of differing resonant frequencies in the cavitating liquid (disclosed, as indicated above, in my U.S. Pat. No. 3,371,233), the same effect is achieved in a one-piece tank/housing of the type shown in FIGS. 6 and 7, without the need of a plurality of separately constituted piezoelectric elements. In this form of the invention, I mold wall 214 as a relatively thick tank wall, while wall 215 is relatively thin as compared to wall 214. Both of these walls may be of a thickness different from that of bottom wall 216. In this form of the invention, the electrodes may be pre-inserted in the mold, and embedded during the molding process directly in the ceramic tank wall material, as in FIGS. 4 and 5. Or, they may be affixed after initial firing of the tank as shown in FIGS. 1–3. In any event, considering the wall 214, the piezoelectric area 230 of this wall is relatively thick. Its electrodes 232, 234 are attached to conductors 236, 238 respectively. Wall 215 is a relatively thin wall so that as contrasted to the piezoelectric element 230 of wall 214, relatively high frequencies will be generated by reason of the thin piezoelectric element or area 240. Area 240 extends between electrodes 242, 244, connected to conductors 246, 248 respectively. Meanwhile, area 221 of the bottom wall 216 is provided with electrodes 222, 224, connected to conductors 226, 228.

This arrangement has decided advantages over existing systems in which a multiplicity of frequencies is generated. In such systems, separate piezoelectric elements are attached, and this is usually done only at the bottom of the tank. By providing a construction where the elements are integrally molded into the side walls or end walls of the tank, and are shaped in any desired outer configuration such as, for example, the rectangular configuration shown in FIG. 7 for electrode 232, the directions in which the cavitating frequencies pass through liquid L are increased with correspondingly higher cleaning efficiency.

In FIG. 8, it is shown that the invention can be applied to a tank/housing which is pre-formed of stainless steel or the like, rather than of molded ceramic. In this form of the invention, the tank 310 can be formed by deep drawing, or by hydraulic (hydro) forming, to which the piezoelectric mixture could be fused during the process of firing that mixture. Thus, tank 310 in this arrangement includes outer walls 312, 313, 314, 315, and an inner wall 332 providing a container for liquid L. A plurality of piezoelectric elements is illustrated as being attached to these walls. In this arrangement, there is a piezoelectric element 330, and an element 321. Each of these, after being molded, has an electrode attached thereto, for example an electrode 334 for the element 330 and an electrode 324 for the element 321. These electrodes have conductors 336, 328 respectively attached thereto.

In this form of the invention, after the elements 330, 321 are molded, they can be fired, so as to fuse the elements both to the inner walls 332 of the tank, and to their associated electrodes. The tank walls become electrodes cooperating with the electrodes 324, 334 and a conductor 338 can be secured to the tank wall for this purpose.

This duplicates all of the previously mentioned advantages found in the ceramic tanks above, in that the elaborate bonding techniques required for connecting a tank to a housing, and also required for connecting electrodes to the tank, are dispensed with.

In FIG. 9, there is shown another form of molded, ceramic tank 410, having walls 412, 413, 414, 415.

In this form of the invention, the piezoelectric element 421 is molded of ceramic, with the electrodes 422, 424 being fused thereto. In this arrangement, the ceramic material of which the tank proper is formed could be of a conventional ceramic mixture, rather than one having a particular capability of being made piezoelectric. Thereafter, the electrodes 422, 424 could be fused into the housing wherever desired, after which the piezoelectric material 421 could be fused to the electrodes in a second firing.

In an alternative arrangement, the construction shown in FIG. 9 might be provided with a single firing, by applying the piezoelectric mixture 421 to a selected area of the regular ceramic mixture at the time of the first firing, with the electrode 422 disposed therebetween so as to be fused both to the piezoelectric and to the tank ceramic material.

The basic concept believed present in the invention is the fusing which takes place during the initial firing of the ceramics. This enables the piezoelectric area to be intimately attached to the metal surface, whether it be the surface of the tank itself or, alternatively, the electrode or electrodes associated with the piezoelectric element. This intimate attachment of the piezoelectric ceramic material to associated metal surfaces is extremely important, as discussed above, to prevent gas from entering between them, in a manner that would attenuate ultrasonic vibrations. Epoxy bonding compounds are presently used, but can be eliminated in accordance with the invention.

In all forms of the invention, of course, the elimination of a separate housing is a very important advantage, because such a housing has to be attached to the tank by elaborate bonding methods that will absolutely preclude liquid from attacking the piezoelectric elements mounted between the tank and the associated housing.

It has been previously discussed that in some instances, the electrodes may be attached to the piezoelectric elements by chemical deposition. If this method is used, the electrode would have to be protected from chemical attack. This could be done by carrying out another ceramic firing operation following the deposition of the electrode upon the piezoelectric element. The steps in this instance would be an original firing, followed by electrode deposition, after which a protective ceramic coating would be applied over the electrode, followed by a second firing to solidify the protective ceramic coating. Therafter, the conventional polarization process would be carried out. Wire leads could be applied to the electrode at the time of the second firing.

It is also believed within the scope of the invention to reinforce the ceramic material of which the tank and/or piezoelectric elements are formed, by the interposition of fibers of plastic, or graphite or metal wires before the initial firing.

Yet another advantage in the invention as disclosed herein is its capability of replacing conventional immersible transducers. At present, problems exist when transducers of this type are employed. It is necessary, at present, to bond the piezoelectric transducer to the bottom of a stainless steel container. The container is then welded shut by a stainless steel cover, which makes the transducer assembly water tight, and which will permit it to be immersed in existing processing tanks.

In the present invention, an advantage is derived in that transducers can be added at a future date to an existing cleaning process tank or tanks. Further, the transducers can be positioned within the cleaning solutions, at the most effective angles to insure thorough cleaning.

In the disclosed invention, problems attendant upon the use of immersible transducers in tanks of the type described above are overcome by fusing the piezoelectric ceramic materials to the stainless steel walls of the tank, and thereafter encapsulating the entire assembly with a second firing of ceramic, to make it water tight. The second firing could be carried out immediately following the initial firing of the assembly to the stainless material discussed with reference to FIG. 8. The waterproof ceramic coating could extend over the entire structure, covering the radiating stainless steel wall material, or may be applied to simply cover the piezoelectric assembly.

In conventional practice, wires must be extended to the immersible transducer, if such a transducer is used, through stainless steel cables or fittings, entering through holes made in the bottom or sides of the tank. This provides a problem with respect to preventing liquid leaks. When the concepts of the present invention are employed, however, this problem is reduced appreciably, since the ceramic coating will enter the areas in which the wires interface with the walls of the tank, to eliminate the possibility of leaks.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An ultrasonic cleaning tank comprising:

(a) a receptacle adapted to confine a liquid in which cavitation may be induced by application of selected frequencies thereto; and (b) at least one piezoelectric element secured to said receptacle and including (1) a ceramic portion, the ceramic material of which is initially fired to impart thereto requisite characteristics of strength and form and which is thereafter polarized to impart a piezoelectric characteristic thereto, and (2) a pair of electrodes for resonating said ceramic portion, said receptacle and electrodes comprising separate members at least one of which must be united with the ceramic portion during the initial firing thereof.

2. An ultrasonic cleaning tank as in claim 1, wherein said receptacle is formed of a ceramic material.

3. An ultrasonic cleaning tank as in claim 2, said ceramic portion being formed separately from the receptacle and being fused to the electrodes.

4. An ultrasonic cleaning tank as in claim 3 wherein the electrodes are fused to the wall of the receptacle.

5. An ultrasonic cleaning tank as in claim 1 wherein the receptacle is formed wholly of metal material and is formed as a single, seamless piece of sheet metal shaped to include outer side walls, inner side walls spaced inwardly from and integral with the outer walls, and a bottom wall integral with the inner walls and forming therewith both a container for said liquid and the member to which the ceramic portion is united during the firing thereof.

6. An ultrasonic cleaning tank comprising:

(a) a receptacle adapted to confine a liquid in which cavitation may be induced by application of selected frequencies thereto; and (b) at least one piezoelectric element including (1) a ceramic portion adapted to be polarized to impart a piezoelectric characteristic thereto, and (2) a pair of electrodes for resonating said ceramic portion, said receptacle and electrodes comprising separate members at least one of which is united with said portion, said receptacle being formed of a ceramic material, the ceramic portion of the piezoelectric element being an integrally molded part of a wall of the receptacle.

7. An ultrasonic cleaning tank as in claim 6 wherein opposite faces of the ceramic portion are recessed, said electrodes being seated in the recesses and secured to the respective, opposite faces of the ceramic portion.

8. An ultrasonic cleaning tank as in claim 7 wherein the electrodes extend through a wall of the receptacle to the exterior thereof.

9. An ultrasonic cleaning tank as in claim 8, said electrodes being molded into the material of which the receptacle is formed.

10. An ultrasonic cleaning tank as in claim 6 wherein the ceramic portion of the piezoelectric element is of a ceramic different from that of the receptacle and selected to impart a characteristic of high strength and resistance to fracture to the wall area in which said ceramic portion is molded.

11. An ultrasonic cleaning tank as in claim 6 wherein there are a plurality of said ceramic piezoelectric portions molded as integral parts of selected walls of the receptacles, said walls differing in thickness from one another so as to correspondingly vary the thickness of the ceramic portions integral therewith.

12. An ultrasonic cleaning tank comprising:

(a) a receptacle adapted to confine a liquid in which cavitation is to be induced by the application of selected frequencies thereto, said receptacle having walls formed wholly of a ceramic material; and (b) at least one piezoelectric element supported upon said receptacle, including (1) an integral portion of a wall of said receptacle, said portion being fired conjointly with said wall to permanently unite said portion and the wall, said portion being separately polarized for resonation thereof at least one predetermined, selected frequency, and (2) a pair of electrodes connectable in an electrical power circuit for resonating said portion of the receptacle wall, said electrodes being mounted on the receptacle and being spaced apart by said portion in intimate, face-to-face contact therewith.

13. An ultrasonic cleaning tank as in claim 12 in which the receptacle is formed as a molded ceramic body fired to produce its final form and having the electrodes inserted into the positions in which they are spaced apart by said portion, prior to the firing of the ceramic material.

14. An ultrasonic cleaning tank as in claim 13 in which the portion of the receptacle included in the piezoelectric element is a ceramic differing from that used in the formation of the remainder of the receptacle.

* * * * *